US010164376B2

(12) United States Patent
Tsay

(10) Patent No.: US 10,164,376 B2
(45) Date of Patent: Dec. 25, 2018

(54) BLOCK-OUT LOCK AND REMOVAL KEY FOR COMPUTER NETWORK PORTS

(71) Applicant: YOU HUNG INTERNATIONAL CO., LTD., New Taipei (TW)

(72) Inventor: Tzu-Rung Tsay, New Taipei (TW)

(73) Assignee: You Hung International Co., Ltd., New Taipei (TW)

( * ) Notice: Subject to any disclaimer, the term of this patent is extended or adjusted under 35 U.S.C. 154(b) by 0 days.

(21) Appl. No.: 15/814,585

(22) Filed: Nov. 16, 2017

(65) Prior Publication Data

US 2018/0076571 A1 Mar. 15, 2018

Related U.S. Application Data

(63) Continuation-in-part of application No. 15/370,323, filed on Dec. 6, 2016, now abandoned.

(51) Int. Cl.

| | |
|---|---|
| ***H01R 13/44*** | (2006.01) |
| ***H01R 13/639*** | (2006.01) |
| ***H01R 24/64*** | (2011.01) |
| ***H01R 13/443*** | (2006.01) |
| *H01R 107/00* | (2006.01) |

(52) U.S. Cl.

CPC ..... *H01R 13/6397* (2013.01); *H01R 13/443* (2013.01); *H01R 24/64* (2013.01); *H01R 2107/00* (2013.01); *H01R 2201/04* (2013.01)

(58) Field of Classification Search

CPC .... H01R 13/44; H01R 13/443; H01R 13/447; H01R 13/6395; H01R 13/6397; H01R 33/97; H01R 13/4538; H01R 13/60; H01R 13/645

USPC ..... 439/133, 304

See application file for complete search history.

(56) References Cited

U.S. PATENT DOCUMENTS

| | | | | |
|---|---|---|---|---|
| 8,202,110 | B2 * | 6/2012 | Morrison | H01R 13/5213 439/344 |
| 8,545,243 | B2 * | 10/2013 | Lin | H01R 13/6397 439/133 |
| 8,845,355 | B2 * | 9/2014 | Litowitz | H01R 13/5213 439/357 |
| 2009/0007609 | A1 * | 1/2009 | Obenshain | H01R 13/6395 70/158 |
| 2009/0047818 | A1 * | 2/2009 | Irwin | G02B 6/3879 439/304 |

(Continued)

*Primary Examiner* — Chandrika Prasad

(74) *Attorney, Agent, or Firm* — Rosenberg, Klein & Lee

(57) ABSTRACT

A block-out lock and removal key includes a locker and a key. The locker has a hollow housing in a shape corresponding to a socket of a network port for engagement, a locker hole extending through a front portion of the housing and a latch body connecting to a rear portion of the housing. The latch body has a rear section extended upwards toward the front portion of the housing and then downwards to form a displaceable piece parallel with the front portion of the housing with a holding section at a top of the displaceable piece and a block facing toward an inner end of the locker hole. The key has its front section arranged correspondingly to a shape of the locker hole to be inserted therein and rotated for unlocking. An eccentric block is further arranged at the front section of the key correspondingly to the block on the displaceable piece for removing the locker from the socket of the network port in operation.

4 Claims, 9 Drawing Sheets

(56) References Cited

U.S. PATENT DOCUMENTS

2017/0214181 A1* 7/2017 Tsay ..... H01R 13/6397

* cited by examiner

BLOCK-OUT LOCK AND REMOVAL KEY FOR COMPUTER NETWORK PORTS

This patent application is a continuation-in-part of Ser. No. 15/370,323 filed on Dec. 6, 2016, currently pending.

BACKGROUND OF THE INVENTION

1. Field of the Invention

The present invention relates to a block-out lock and removal key, particularly to one that unlocks a locker from a network port by a key.

2. Description of the Related Art

Nowadays internet networks have been widely applied in information transfer. Such networks mainly rely on the Ethernet networks for rapid and stable transfer, which is suitable in many industries such as the government, the police, the military, and business companies; however, such technology also allows unauthorized users to have access to the information and data easily, leaving uncertainties in information security.

There are various locks designed for such problem in the markets. For example, a block-out cover and a removal tool are disclosed in U.S. Pat. No. 8,202,110. The device covers jack modules to prevent from undesirable accessibility, and further has a tool to remove the cover from the jack modules. The removal tool is a tweezer that engages the cover and removes it by clamping and pulling. Such operation could damage the device with improper pulling angle and pulling forces; also, the operation will be unsmooth once a minor damage is done.

SUMMARY OF THE INVENTION

A primary objective of the present invention is to provide a block-out lock and removal key that ensures more safety in accessibility to data via the internet networks by having a network port locked by a locker and unlocked by a key smoothly.

To achieve the objective, the present invention comprises a locker and a key.

The locker includes a hollow housing arranged in a shape corresponding to a socket of a network port for engagement and including a front portion, a rear portion, and two corresponding lateral portions, wherein a locker hole is arranged relative to the front portion of the housing, said locker hole penetrating through the front portion and having a blocking element arranged in a substantially semicircular shape therein to form a substantially semicircular through hole within the locker hole; a latch body having a rear section linking to a top of the rear portion of the housing, extending slightly upwards toward the front portion of the housing to form an inclined portion and then downwards from a top edge of the inclined portion to form a displaceable piece parallel with the front portion of the housing and leaving a gap in-between the displaceable piece and the front portion, said top edge of the inclined portion being lower than a top of the front portion, said displaceable piece is further formed to extend from a holding section at an acute angle (from the top edge of the inclined portion) and having a free end with a block at a bottom thereof facing toward the front portion of the housing corresponding to the locker hole.

The key has a front section arranged in a shape corresponding to a shape of the locker hole for engagement, said front section including an engaging section for engaging in the locker hole and rotating in the through hole and an eccentric block arranged at a front end of the front section corresponding to the block of the displaceable piece for passing through the through hole to the gap and located above the block for operation.

Whereby when the locker is engaged in the socket of the network port, the holding section abuts on a pair of symmetrical staircase edges at an upper part of the network port and locks up the socket of the network port; then when the key is inserted into the locker hole and rotated, the eccentric block presses the block of the displaceable piece downwards to displace the displaceable piece downwards and release the abutting status of the holding section from the staircase edges of the network port, so as to unlock the network port for use.

Furthermore, the key further has a protrusion at a side thereof for recognition when it is inserted into the locker hole. The locker hole further has a positioning space arranged along a quarter of an inner periphery of the locker hole and the key further has a positioning ridge on an outer periphery of the front section corresponding to the positioning space in the locker hole, thereby the positioning ridge is rotated within the positioning space when the key is rotated for unlocking.

With structures disclosed above, the present invention has the eccentric block to remove the locker together with the key from a network port for which to be accessible for information and data via the internet connection. Therefore, the device is easier operated and has less possibility of damages than a conventional lock unlocked by a tweezer.

DETAILED DESCRIPTION OF THE PREFERRED EMBODIMENT

Figure 1A:
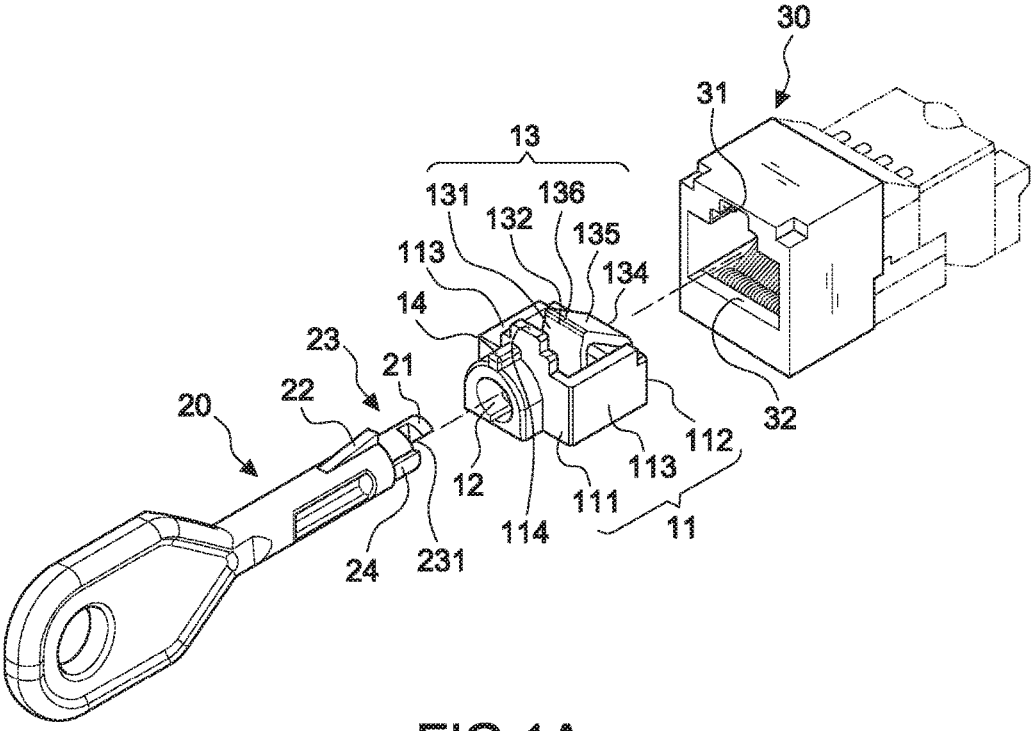
FIG. 1A is an exploded view of the present invention in a preferred embodiment.

With reference to FIGS. 1A-4C, in a preferred embodiment, a block-out lock and removal key for computer network ports comprises a locker 10 and a key 20 for the locker 10.

The locker 10 includes a hollow housing 11, a locker hole 12 and a latch body 13. The housing 11 is arranged in a shape corresponding to a socket 32 of a network port 30 for engagement and further includes a front portion 111, a rear portion 112 and two corresponding lateral portions 113.

Figure 1B:
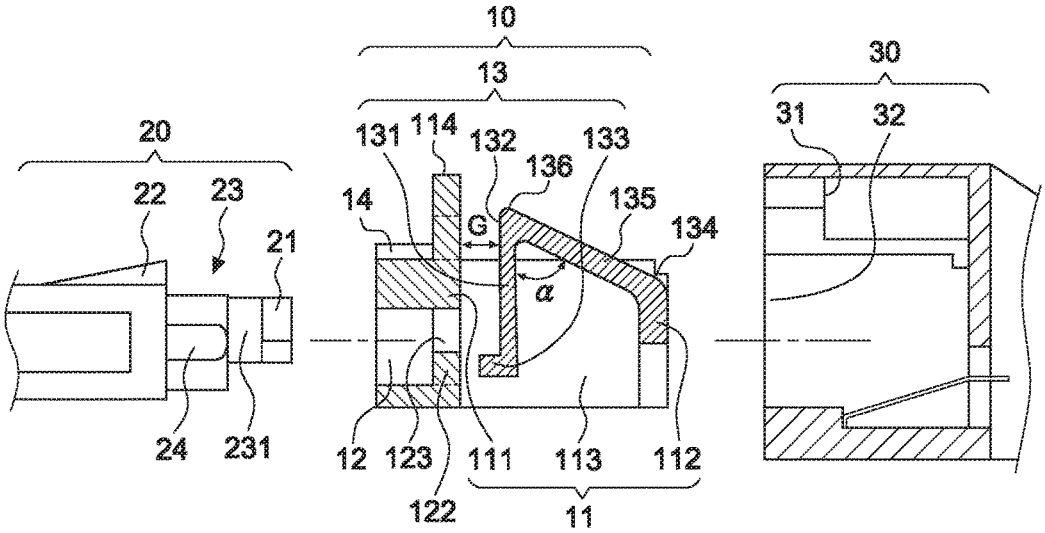
FIG. 1B is a sectional view of the present invention in a preferred embodiment without engagement of elements thereof.
Figure 1C:
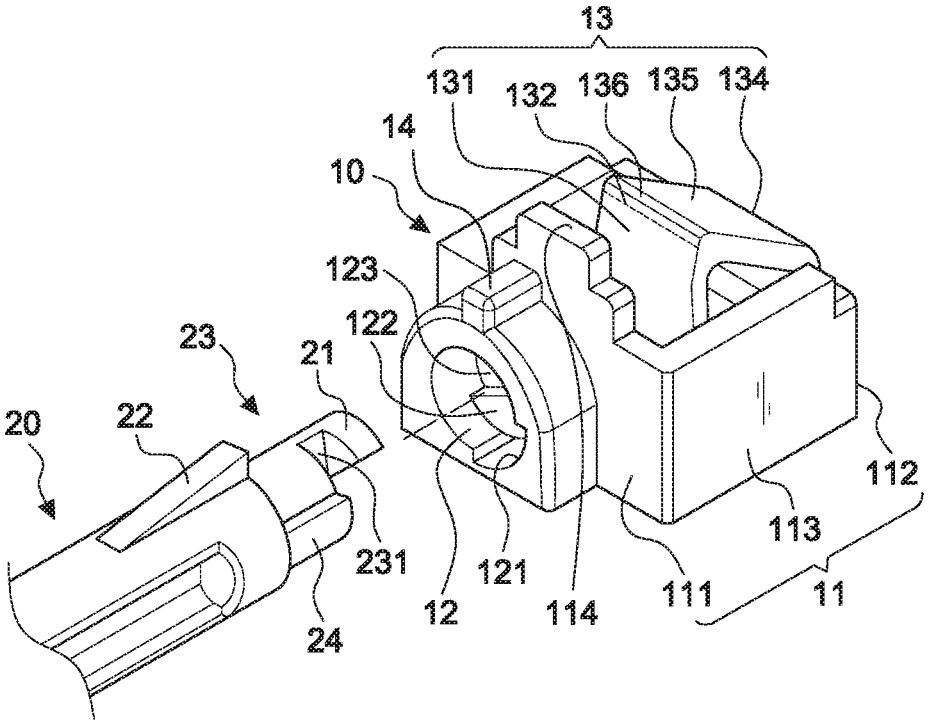
FIG. 1C is a partially enlarged view of a locker and a key according to the present invention in a preferred embodiment.
Figure 1D:
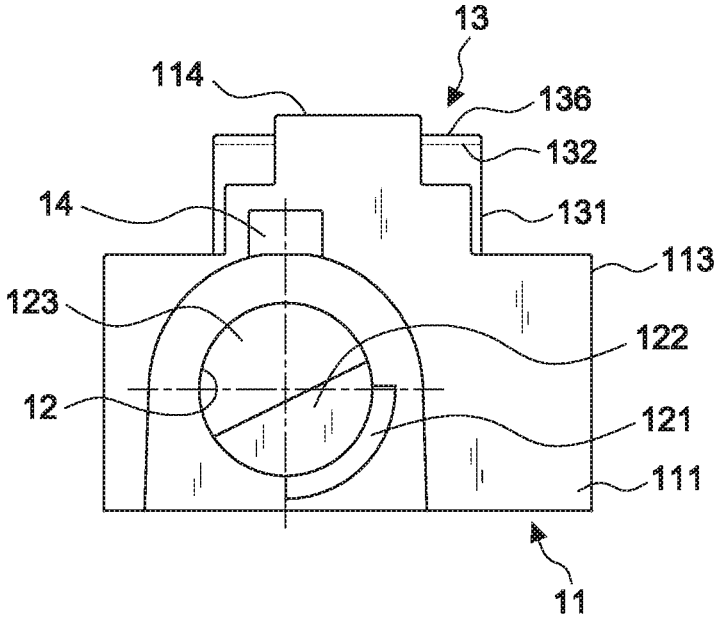
FIG. 1D is a front elevation view of the locker according to the present invention in a preferred embodiment.
Figure 1E:
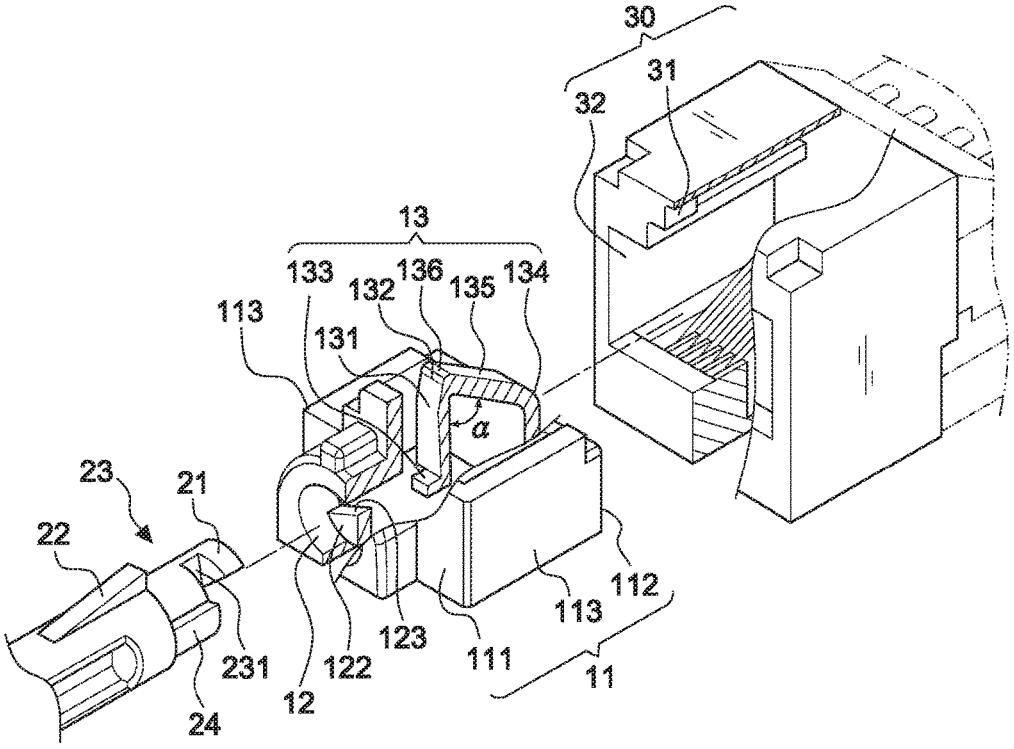
FIG. 1E is a partially exploded view of FIG. 1A.

The locker hole 12 extends through the front portion 111 and further includes a blocking element 122 arranged in a semicircular shape therein to form a semicircular through hole 123 within the locker hole 12 as shown in FIGS. 1B, 1D and 1E.

The latch body 13 has a rear section 134 linking to a top of the rear surface 112 of the housing 11, extending slightly upwards toward the front portion 111 of the housing 11 to form an inclined portion 135 and then downwards from a top edge 136 of the inclined portion 135 to form a displaceable piece 131 having a front surface of the displaceable piece 131 parallel to a rear surface of the front portion 111 of the housing 11 and leaving a gap G in-between the displaceable piece 131 and the front portion 111 as shown in FIG. 1B. The top edge 136 of the inclined portion 135 is arranged lower than a top 114 of the front portion 111. The displaceable piece 131 is arranged closer to the front portion 111 of the housing than to the rear portion 112 and is further formed to extend from a holding section 132. The holding section 132 extends from the top edge 136 of the inclined surface portion 135 as shown in FIGS. 1A and 1B. The inclined portion 135 has a top surface and a bottom surface. An acute angle $\alpha$ is formed between a rear surface the displaceable piece 131 and the bottom surface of the inclined portion 135. A free end with a block 133 is arranged at a bottom of the displaceable piece 131, facing toward the front portion 111 of the housing 11 correspondingly to the locker hole 12. As also evident from FIGS. 1A and 1B, the top edge 136 of the inclined portion 135 and the holding section 132 are collinear.

Figure 3A:
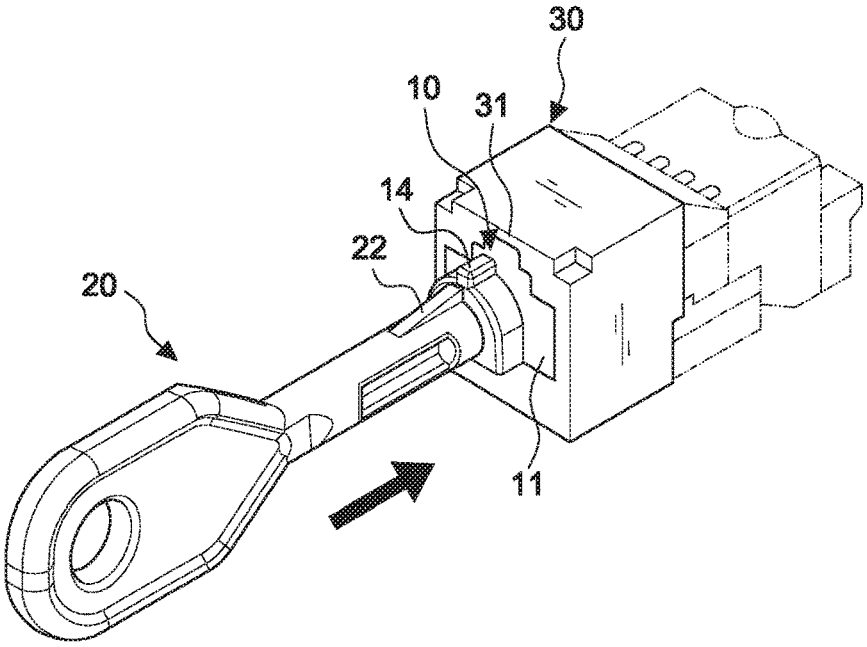
FIG. 3A is a perspective view of the present invention in a preferred embodiment, showing the locker locking up the network port.
Figure 3B:
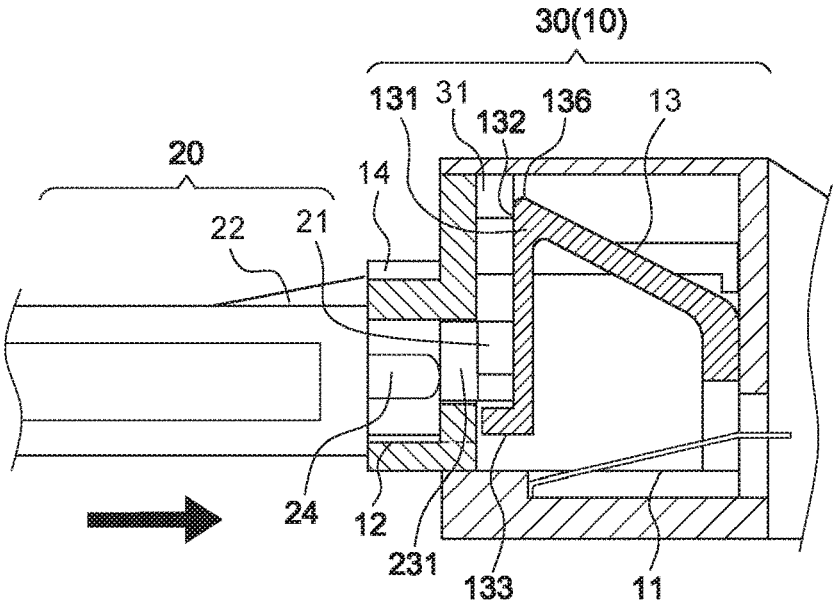
FIG. 3B is a sectional view of the present invention in a preferred embodiment, showing the locker locking up the network port.
Figure 3C:
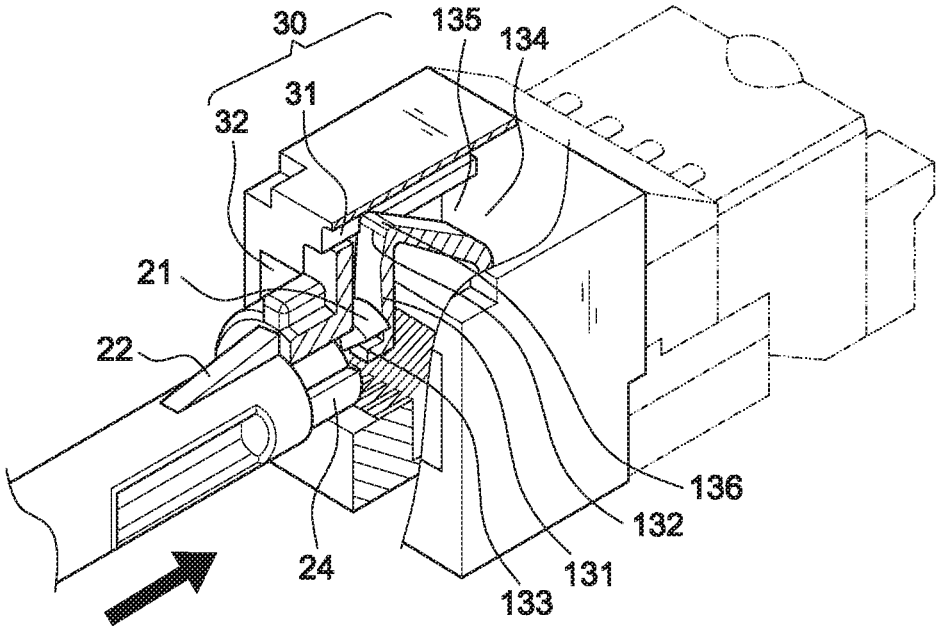
FIG. 3C is a partially exploded view of FIG. 3A.

The key 20 has a front section 23 arranged in a shape corresponding to a shape of the locker hole 12 for engagement, and the front section 23 includes an engaging section 231 for engaging in the locker hole 12 and rotating in the through hole 123 and an eccentric block 21 arranged at a front end of the front section 23 corresponding to the block 133 of the displaceable piece 131 for passing through the through hole 123 to the gap G between the front surface of the displaceable piece 131 and the rear surface of the front portion 111 of the housing 11 and located above the block 133 of the displaceable piece 131 for operation as shown in FIGS. 3B and 3C.

Figure 2A:
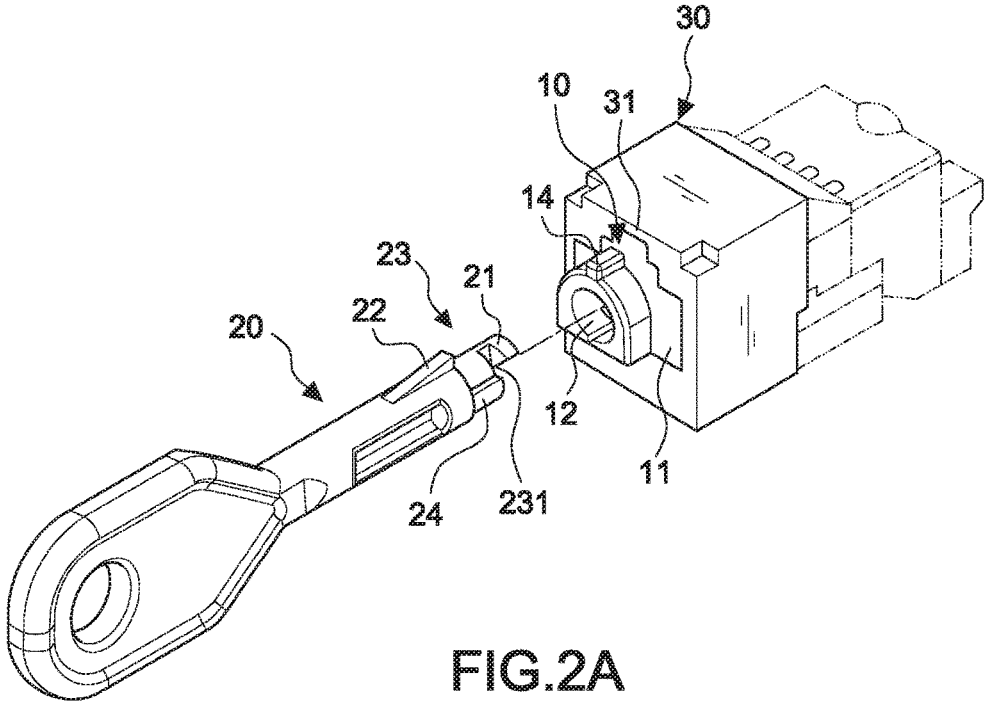
FIG. 2A is a perspective view of the present invention in a preferred embodiment.
Figure 2B:
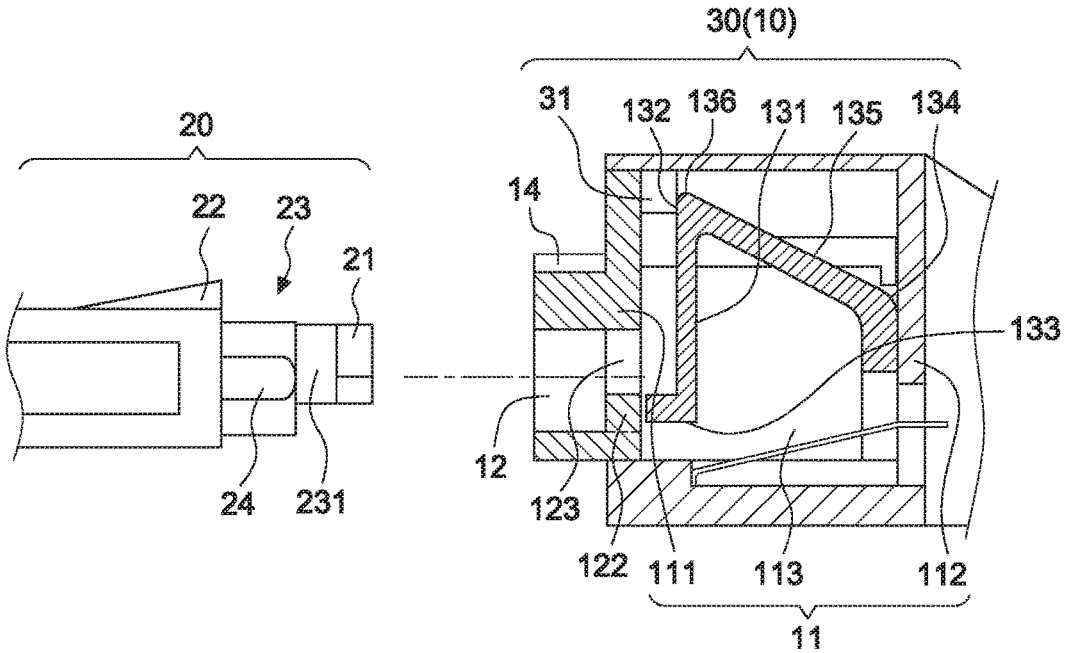
FIG. 2B is a sectional view of the present invention in a preferred embodiment with a locker thereof locking up a socket of a network port.
Figure 2C:
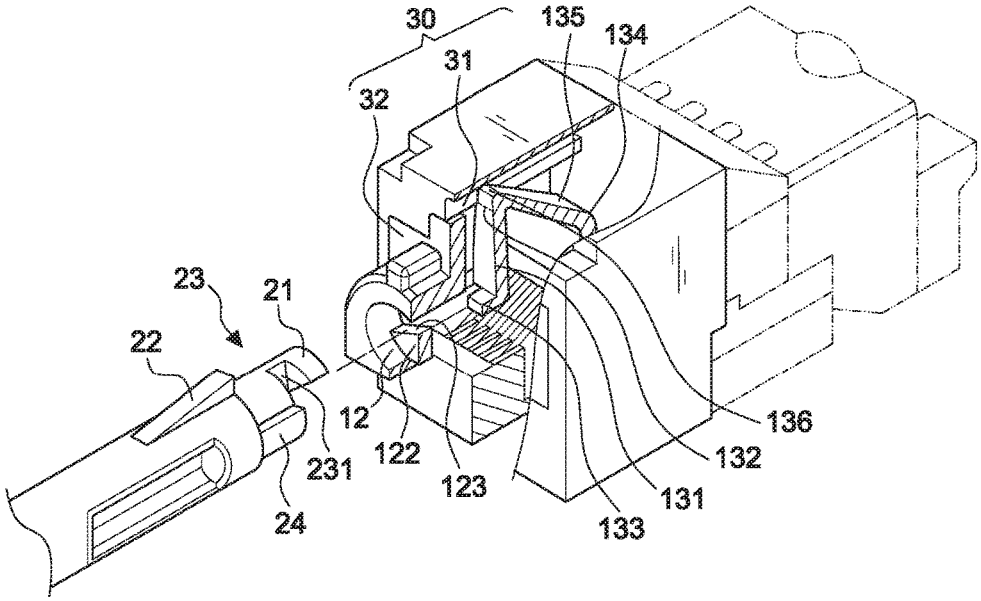
FIG. 2C is a partially exploded view of FIG. 2A.
Figure 4A:
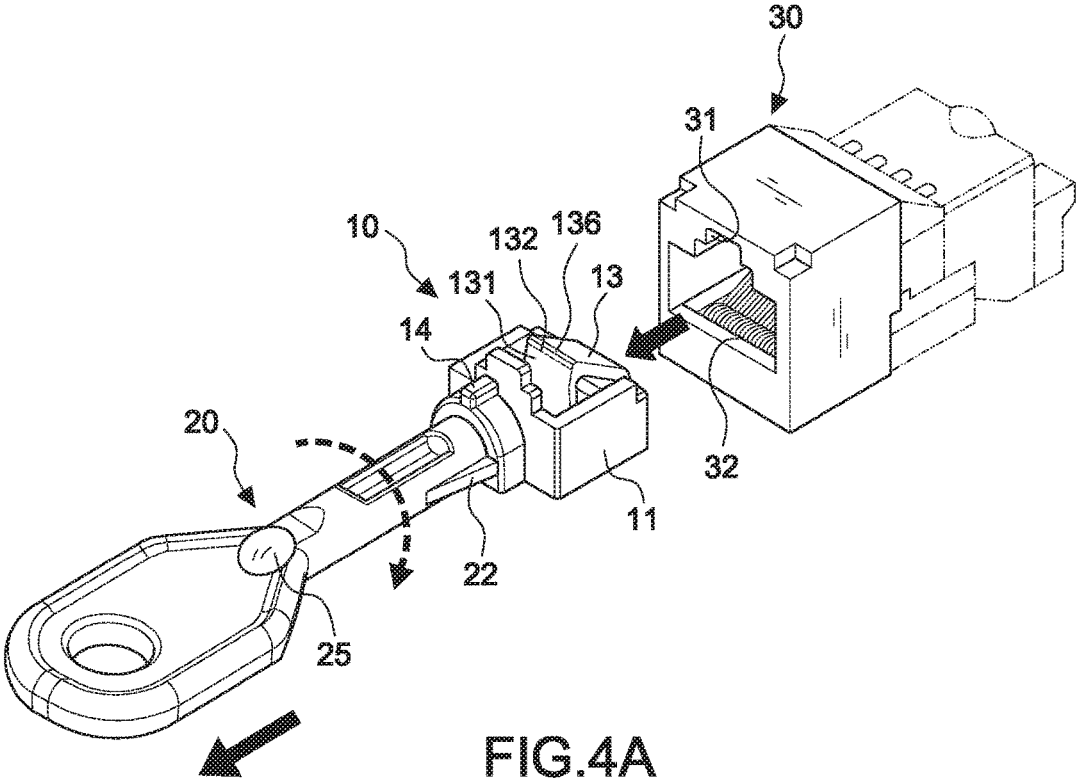
FIG. 4A is a perspective view of the present invention in a preferred embodiment, showing the locker being pulled by the key from the network port for unlocking.
Figure 4B:
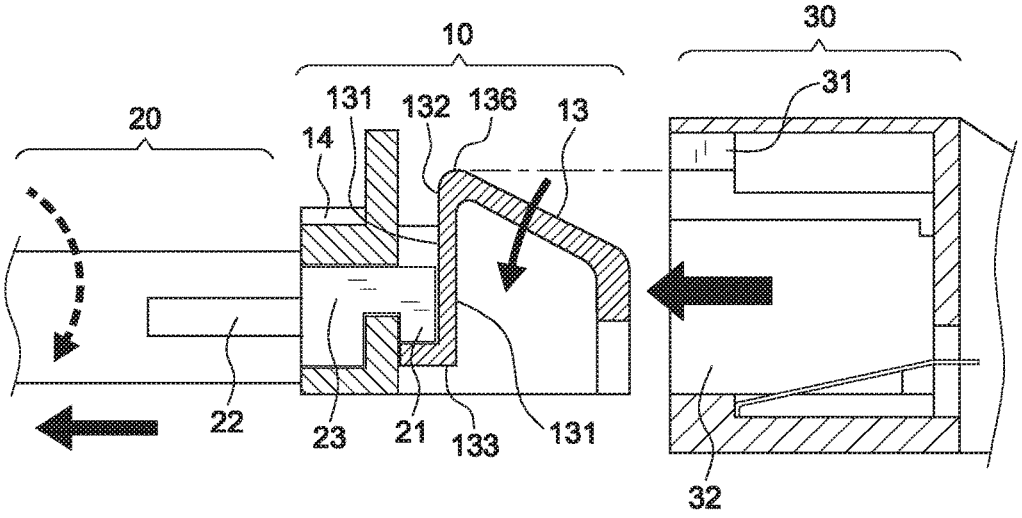
FIG. 4B is a sectional view of the present invention in a preferred embodiment, showing the locker unlocking the network port.
Figure 4C:
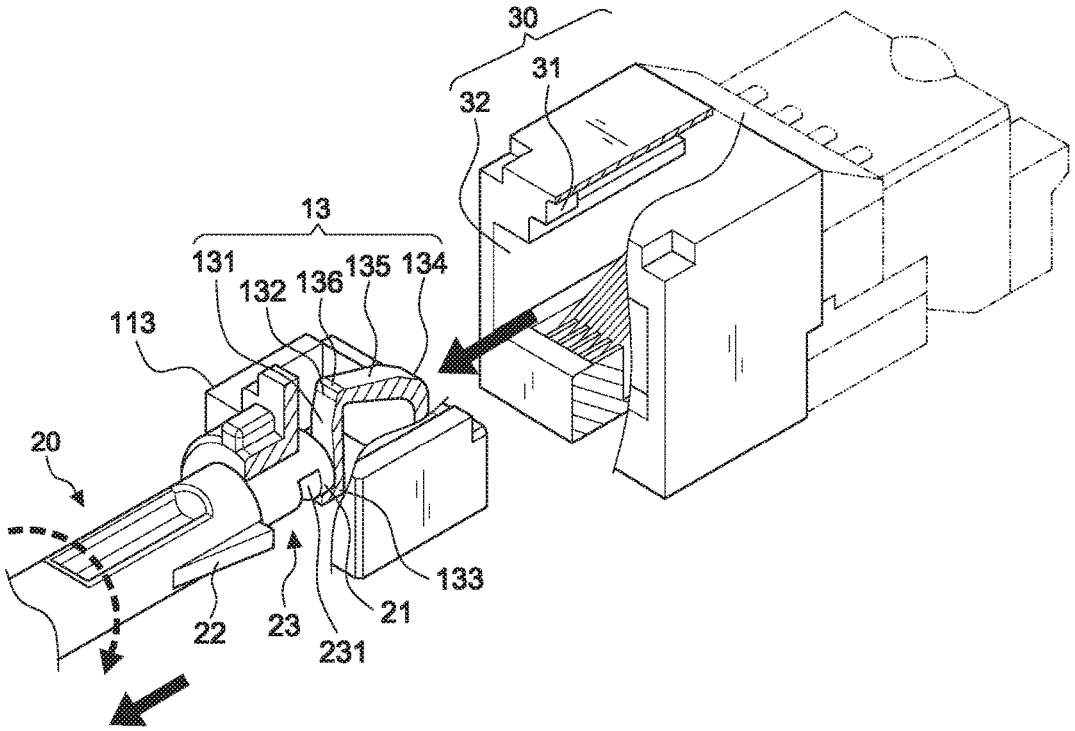
FIG. 4C is a sectional view in partial of the present invention in a preferred embodiment, illustrating the locker being pulled by the key from the network port for unlocking.

Further referring to FIGS. 2A-2C, when the locker 10 is engaged in the socket 32 of the network port 30, the holding section 132 abuts on a staircase edge 31 of the network port 30 and locks up the socket 32 of the network port 30; the staircase edge 31 is arranged in a symmetrical pair at an upper part of the network port 30 as shown in FIGS. 3A and 3B. Then when the key 20 is inserted into the locker hole 12 and rotated, the eccentric block 21 presses the block 133 of the displaceable piece 131 downwards to displace the displaceable piece 131 downwards and release the abutting status of the holding section 132 from the staircase edge 31 of the network port 30, so as to pull out the locker 10 together with the key 20 and unlock the network port 30 for use as shown in FIGS. 4A and 4B.

In addition, the key 20 has an aligning section 22 at a substantially middle section thereof corresponding to a reference portion 14 arranged relative to the housing 11 above the locker hole 12 and an outer surface of the reference portion 14 is coplanar with respect to an outer surface of the locker hole 12, so that the aligning section 22 is aligned with the reference portion 14 when inserting the key 20 to unlock the locker 10.

Also, the key 20 has a protrusion 25 at a side thereof for recognition so that a user can perform unlocking simply by recognizing a position of the protrusion 25 without looking to confirm if the key 20 is inserted properly. In this embodiment, the protrusion 25 can be a solid block or linear protrusion.

As illustrated in FIGS. 1C and 1D, the locker hole 12 further has a positioning space 121 arranged along a quarter of an inner periphery of the locker hole 12 and the key 20 further has a positioning ridge 24 on an outer periphery of the front section 23 corresponding to the positioning space 121 in the locker hole 12, thereby the positioning ridge 24 is rotated within the positioning space 121 when the key 20 is rotated for unlocking the locker 10. In other words, the rotation of the key 20 can be controlled precisely since the rotation of the positioning ridge 24 is limited by the positioning space 121, and the downward displacement of the block 133 by the eccentric block 21 is therefore controlled with precision as well.

In short, the block-out lock and removal key includes the eccentric block 21 to remove the locker 10 together with the key 20 to unlock the network port 30, which is comparatively safer and easier than a conventional device that has a tweezer as a removal tool to take out a locker device. More importantly, with such structures, the device is able to avoid damages that can be caused by conventional devices.

What is claimed is:

1. A block-out lock and removal key for computer network ports, comprising:

a locker; and a key;

said locker including:

a hollow housing arranged in a shape corresponding to a socket of a network port for engagement therewith and including a front portion, a rear portion, and two corresponding lateral portions, wherein a locker hole extends through the front portion of the housing, said locker hole having a blocking element arranged in a substantially semicircular shape therein to form a substantially semicircular through hole within the locker hole; and a latch body having a rear section linking to a top of the rear portion of the housing, extending slightly upwards toward the front portion of the housing to form an inclined portion and then downwards from a top edge of the inclined portion to form a displaceable piece having a front surface of the displaceable piece parallel to a rear surface of the front portion of the housing and leaving a gap in-between the front surface of the displaceable piece and the rear surface of the front portion of the housing, said top edge of the inclined portion being lower than a top of the front portion, said displaceable piece being formed to extend from a holding section, the holding section extending from the top edge of the inclined portion, the inclined portion having a top surface and a bottom surface, the latch body having an acute angle formed between a rear surface the displaceable piece and the bottom surface of the inclined portion, the displaceable piece having a free end with a block at a bottom thereof facing toward the front portion of the housing corresponding to the locker hole; and said key having a front section arranged in a shape corresponding to a shape of the locker hole for engagement therewith, said front section including an engaging section for engaging in the locker hole and rotating in the through hole and an eccentric block arranged at a front end of the front section corresponding to the block of the displaceable piece for passing through the through hole to the gap and located above the block of the displaceable piece for operation;

whereby when the locker is engaged in the socket of the network port, the holding section abuts against a pair of symmetrical staircase edges at an upper part of the network port and locks up the socket of the network port; and when the key is inserted into the locker hole and rotated, the eccentric block presses the block of the displaceable piece downwards to displace the displaceable piece downwards and release the holding section from abutting against the staircase edges of the network port, the network port is thereby unlocked for use.

2. The block-out lock and removal key for computer network ports as claimed in claim 1, wherein the key includes an aligning section at a substantially middle section thereof corresponding to a reference portion arranged relative to the housing and an outer surface of the reference portion is coplanar with respect to an outer surface of the locker hole, the aligning section is thereby aligned with the reference portion when inserting the key to unlock the locker.

3. The block-out lock and removal key for computer network ports as claimed in claim 1, wherein the key further includes a protrusion at a side thereof indicating proper orientation of the key when the key is inserted into the locker hole.

4. The block-out lock and removal key for computer network ports as claimed in claim 1, wherein the locker hole further includes a positioning space arranged along a quarter of an inner periphery of the locker hole and the key further includes a positioning ridge on an outer periphery of the front section corresponding to the positioning space in the locker hole, thereby the positioning ridge is rotated within the positioning space when the key is rotated for unlocking.

* * * * *